US007560978B2

(12) United States Patent
Byeon et al.

(10) Patent No.: US 7,560,978 B2
(45) Date of Patent: Jul. 14, 2009

(54) INTERNAL VOLTAGE DETECTION CIRCUIT

(75) Inventors: Sang-Jin Byeon, Kyoungki-do (KR); Tae-Yun Kim, Kyoungki-do (KR); Jun-Gi Choi, Kyoungki-do (KR)

(73) Assignee: Hynix Semiconductor Inc., Kyoungki-do (KR)

( * ) Notice: Subject to any disclaimer, the term of this patent is extended or adjusted under 35 U.S.C. 154(b) by 24 days.

(21) Appl. No.: 11/806,558

(22) Filed: Jun. 1, 2007

(65) Prior Publication Data

US 2007/0279123 A1 Dec. 6, 2007

(30) Foreign Application Priority Data

Jun. 1, 2006 (KR) ..... 10-2006-0049434

(51) Int. Cl.
*G05F 1/10* (2006.01)

(52) U.S. Cl. ..... 327/536; 327/537; 327/512; 327/378

(58) Field of Classification Search ..... 327/530, 327/534–537, 512, 513, 262, 378
See application file for complete search history.

(56) References Cited

U.S. PATENT DOCUMENTS 5,396,114 A * 3/1995 Lee et al. ..... 327/535
5,886,567 A 3/1999 Park et al.
5,889,664 A 3/1999 Oh
6,169,426 B1 1/2001 Lee et al.
7,009,904 B2 3/2006 Kim
7,310,014 B2 * 12/2007 Lee et al. ..... 327/536
2002/0017946 A1 * 2/2002 Fujii et al. ..... 327/534

FOREIGN PATENT DOCUMENTS

JP 10-199244 7/1998
JP 2000-011649 1/2000
JP 2005-340337 12/2005

OTHER PUBLICATIONS

Korean Office Action, with English Translation, issued in Korean Patent Application No. KR 10-2007-0052643, dated May 26, 2008.
Korean Notice of Allowance issued in Korean Patent Application No. KR 10-2007-0052654, dated Aug. 22, 2008.

* cited by examiner

*Primary Examiner*—An T Luu
(74) *Attorney, Agent, or Firm*—McDermott Will & Emery LLP

(57) ABSTRACT

An internal voltage generator for use in a semiconductor memory device includes a first voltage detection unit, a second voltage detection unit, a detection signal generation unit, and an internal voltage generation unit. The first voltage detection unit detects a voltage level of an internal voltage changing linearly depending on a temperature variation to output a first detection signal. The second voltage detection unit detects the voltage level having a constant value without concerning the temperature variation to output a second detection signal. The detection signal output unit combines the first and the second detection signal to generate a combined detection signal for detecting the voltage level linearly varying according to the temperature variation in a first range of temperature and detecting the voltage level having the constant value in a second range of temperature.

21 Claims, 11 Drawing Sheets

INTERNAL VOLTAGE DETECTION CIRCUIT

CROSS-REFERENCE TO RELATED APPLICATION

The present invention claims priority of Korean patent application number 10-2006-0049434, filed on Jun. 1, 2006, which is incorporated by reference in its entirety.

BACKGROUND OF THE INVENTION

Most semiconductor devices including a dynamic random access memory (DRAM) use internal voltages generated from external voltages, e.g., a power supply voltage VDD and a ground voltage VSS. Generally the internal voltages are generated by using the external voltages and a reference voltage having a target level of the internal voltage through a charge pumping method or a voltage down converting method. In case of DRAM, voltages such as a high voltage VPP and a bulk bias voltage VBB are generated through the charge pumping method. Further, voltages such as a core voltage VCORE and a bit line precharge voltage VBLP are generated through a voltage down converting method.

The high voltage VPP has a higher voltage level than the power supply voltage VDD and is usually used for driving a word line. The bulk bias voltage VBB has a lower voltage level than a ground voltage VSS. The bulk bias voltage VBB is used for a cell transistor in DRAM to increase a data retention time of a unit cell including the cell transistor.

FIG. 1 is a block diagram of a conventional bulk bias voltage generator.

The conventional bulk bias voltage generator includes a bulk bias voltage (VBB) detector 10, an oscillator 20, a pump controller 30, and a charge pump 40. The VBB detector 10 outputs a pump enable signal BBEB based on a reference voltage VREFB and the bulk bias voltage VBB fed back from a DRAM. The reference voltage VREFB is usually generated by a band gap circuit and has a target voltage level of the bulk bias voltage VBB. The oscillator 20 performs an oscillating operation with a predetermined frequency in response to the pump enable signal BBEB to output an oscillation signal OSC. The pump controller 30 receives the oscillation signal OSC and generates a pump control signal PUMP_CTRL. The charge pump 40 performs a pump operation in response to the pump control signal PUMP_CTRL to generate the bulk bias voltage VBB.

After a voltage level of the power supply voltage VDD is stabilized to a predetermined voltage level, the internal voltage generators, including the bulk bias voltage VBB generator, start to generate internal voltages. Before the bulk bias voltage VBB generator is enabled, the bulk bias voltage VBB has a voltage level substantially the same as that of the ground voltage VSS level. The VBB detector 10 detects the voltage level of the bulk bias voltage VBB and activates the pump enable signal BBEB. The oscillator 20 starts to perform the oscillating operation in response to the pump enable signal BBEB and outputs the oscillation signal OSC having the predetermined frequency. The pump controller 30 activates the pump control signal PUMP_CTRL in response to the oscillation signal OSC. The above mentioned operations for pumping the bulk bias voltage VBB are repeatedly performed until the voltage level of the bulk bias voltage VBB reaches the target level which is determined by the reference voltage VREFB.

Meanwhile, the conventional VBB detector 10 includes a normal detector, a modulation detector. The normal detector detects the constant voltage level of the bulk bias voltage VBB without concerning temperature variations. The modulation detector detects the voltage level of the bulk bias voltage VBB with linearly depending on the temperature variation. The conventional VBB detector 10 employs one of outputs of the normal detector and the modulation detector by using a metal option.

FIG. 2 is a schematic circuit diagram of the VBB detector shown in FIG. 1.

The VBB detector 10 includes a VBB normal detector 10A, a VBB modulation detector 10B, a selection unit 10C. The VBB normal detector 10A detects a voltage level of the bulk bias voltage VBB without regarding to temperature variation and outputs a normal detection value DET_N. The VBB modulation detector 10B detects the voltage level of the bulk bias voltage according to temperature variation and outputs a modulated detection value DET_T. The selection unit 10C selects one of the normal detection value DET_N and the modulated detection value DET_T according to a metal option and outputs the selected one as the pump enable signal BBEB.

The VBB normal detector 10A includes two PMOS transistors P1 and P2 serially connected each other and a first inverter INV1. The first PMOS transistor P1 connected between a reference voltage VREFB terminal and a first node NODE_1. The first PMOS transistor P1 receives the ground voltage VSS through its gate. Further, a bulk of the first PMOS transistor P1 is connected to the reference voltage VREFB terminal. The second PMOS transistor P2 is connected to the first node NODE_1 and a ground voltage VSS terminal. The second PMOS transistor P2 receives the bulk bias voltage VBB through its gate. Further, a bulk of the second PMOS transistor P2 is connected to the reference voltage VREFB terminal. The first inverter INV1 receives voltage loaded at the first node NODE_1 to thereby output as the normal detection value DET_N. The first inverter INV1 receives a voltage loaded at the first node NODE_1 and outputs the normal detection value DET_N.

The VBB normal detector 10A detects a level of the bulk bias voltage VBB by using a resistance difference of the first and the second PMOS transistors P1 and P2. In detail, when an absolute value of the voltage level of the bulk bias voltage VBB is small, a resistance of the second PMOS transistor P2 increases. Accordingly, the voltage level of a voltage loaded at the first node NODE_1 is higher than a switching point of the first inverter INV1 and, therefore, the normal detection value DET_N becomes a logic low level. Further, when the absolute value of the voltage level of the bulk bias voltage VBB is large, the resistance of the second PMOS transistor P2 decreases. Hence, the voltage level of the voltage loaded at the first node NODE_1 is lower than the switching point of the first inverter INV1 and, therefore, the normal detection value DET_N becomes a logic high level. In an embodiment of the present invention, the switching point of the first inverter INV1 is set to have a half level of the reference voltage VREFB.

As mentioned above, the VBB detector 10 selects one of the normal detection value DET_N and the modulated detection value DET_T and outputs the selected one as the pump enable signal BBEB. Therefore, in case that the metal option is set to select the normal detection value DET_N as the pump enable signal BBEB, the pump enable signal BBEB has the same logic level with the normal detection value DET_N. That is, when the normal detection value DET_N has the logic low level, the pump enable signal BBEB is activated as a logic low level. In response to an activation of the pump enable signal BBEB, the VBB pumping unit 20 performs a pumping operation and, therefore, the absolute value of the voltage level of the bulk bias voltage VBB increases. When normal detection value DET_N has the logic high level, the pump enable signal BBEB is inactivated as a logic high level. In response to an inactivation of pump enable signal BBEB, the VBB pumping unit 20 stops performing the pumping operation and, therefore, the absolute value of the voltage level of the bulk bias voltage VBB decreases. That is, the bulk bias voltage VBB has a constant voltage level.

The VBB modulation detector 10B includes a third PMOS transistor P3, an NMOS transistor N1, and a second inverter INV2. The third PMOS transistor P3 and the NMOS transistor N1 are serially connected each other between the reference voltage VREFB terminal and a bulk bias VBB terminal. The third PMOS transistor P3 is connected between the reference voltage VREFB terminal and a second node NODE_2. The third PMOS transistor P3 receives the ground voltage VSS through its gate. A bulk of the third PMOS transistor P3 is connected to the reference voltage terminal VREFB. The NMOS transistor N1 is connected to the second node NODE_2 and the bulk bias voltage VBB terminal. The NMOS transistor N1 receives the reference voltage VREFB through its gate. A bulk of the NMOS transistor N1 is connected to the bulk bias voltage VBB terminal. The second inverter INV2 receives a voltage loaded at the second node NODE_2 to thereby output as the modulated detection value DET_T.

The VBB modulation detector 10B detects the level of the bulk bias voltage VBB by using a resistance difference of the third PMOS transistor P3 and the NMOS transistor N1. In detail, when an absolute value of the voltage level of the bulk bias voltage VBB is small, a resistance of the NMOS transistor N1 increases. Accordingly, the voltage level of a voltage loaded at the second node NODE_2 is higher than a switching point of the second inverter INV2 and, therefore, the modulated detection value DET_T becomes a logic low level. Further, when the absolute value of the voltage level of the bulk bias voltage VBB is large, the resistance of the NMOS transistor N1 is decreases. Hence, the voltage level of the voltage loaded at the second node NODE_2 is lower than the switching point of the second inverter INV2 and, therefore, the modulated detection value DET_T becomes a logic high level.

An operation of the VBB modulation detector 10B is dependent on temperature because a resistance of a PMOS transistor decreases more rapidly than that of an NMOS transistor as temperature decreases. That is, as temperature decreases, the absolute value of the voltage level of the bulk bias voltage VBB decreases because the resistance of the third PMOS transistor P3 more rapidly decreases than that of the NMOS transistor N1. In the same way, as the temperature increases, the absolute value of the bulk bias voltage VBB is increases.

FIG. 3 is a graph showing the voltage levels of the normal detection value DET_N and the modulated detection value DET_M respectively output from the VBB normal detector 10A and the VBB modulated detector 10B shown in FIG. 2.

The voltage level of the bulk bias voltage VBB detected by the VBB normal detector 10A has a constant voltage level without considering a temperature variation. The voltage level of the bulk bias voltage VBB detected by the VBB modulation detector 10B linearly varies according to the temperature variation. That is, as the temperature decreases, the absolute value of the voltage level of the bulk bias voltage VBB decreases.

When the VBB normal detector 10A is used at a high temperature, a data retention time of a unit cell increases. However, when the VBB normal detector 10A is used at a low temperature, time for writing a data into the unit cell increases. When the VBB modulation detector 10B is used to detect the voltage level of the bulk bias voltage VBB, it is possible to increase the data retention time of the unit cell for a high temperature environment and to decrease the time taken for writing a data into the unit cell. However, because the voltage level of the bulk bias voltage VBB linearly changes according to the variation of the temperature, the absolute value of the voltage level of the bulk bias voltage VBB has too high value or too low value when the temperature is extremely low or high.

SUMMARY OF THE INVENTION

Embodiments of the present invention are directed to providing an internal voltage detection circuit for preventing an operation error usually caused at very high and low temperature circumstances.

In accordance with an aspect of the present invention, there is provided an internal voltage generator for use in a semiconductor memory device including a first voltage detection unit, a second voltage detection unit, a detection signal generation unit, and an internal voltage generation unit. The first voltage detection unit detects a voltage level of an internal voltage changing linearly depending on a temperature variation to output a first detection signal. The second voltage detection unit detects the voltage level having a constant value without concerning the temperature variation to output a second detection signal. The detection signal output unit combines the first and the second detection signals to generate a combined detection signal for detecting the voltage level linearly varying according to the temperature variation during a first range of temperature and detecting the voltage level having the constant value during a second temperature. The internal voltage generation unit generates the internal voltage by performing a charge pumping operation in response to the combined detection signal.

In accordance with another aspect of the present invention, there is provided an internal voltage generator for use in a semiconductor memory device including a first voltage detection unit, a second voltage detection unit, a third voltage detection unit, a detection signal output unit, and an internal voltage generation unit. The first voltage detection unit detects a modulated voltage level of an internal voltage changing linearly depending on temperature variation to output a first detection signal. The second voltage detection unit detects a high limit voltage level of the internal voltage having a first constant value without concerning the temperature variation. The third voltage detection unit detects a low limit voltage level of the internal voltage unit having a second constant value without concerning the temperature variation. The detection signal output unit combines the modulated voltage level, the low limit voltage level, and the high limit voltage level to generate a combined detection signal. The internal voltage generation unit performs a charge pumping operation in response to the combined detection signal to generate the internal voltage. The combined detection signal has the modulated voltage level during a first temperature section, has the high limit voltage level during a second temperature section, has the low limit voltage level during a third temperature section. The internal voltage generator as recited in claim 7, wherein the second temperature section has the lower temperature than the first temperature section; and the third temperature section has the higher temperature than the first temperature section.

In accordance with still another aspect of the present invention, there is provided an internal voltage generator for use in a semiconductor memory device including a first voltage detection unit, a second voltage detection unit, a third voltage detection unit, a fourth voltage detection unit, a first selection unit, a detection signal output unit, a second selection unit, and an internal voltage generation unit. The first voltage detection unit detects a modulated voltage level of an internal voltage changing linearly depending on temperature variation to output a first detection signal. The second voltage detection unit detects a high limit voltage level of the internal voltage having a first constant value without concerning the temperature variation. The third voltage detection unit detects a low limit voltage level of the internal voltage unit having a second constant value without concerning the temperature variation. The fourth voltage detection unit detects a normal voltage level having a third constant value lower than the high limit voltage level and higher than the low limit voltage level. The first selection unit selectively outputs one of the modulated voltage level and the normal voltage level as a selection signal. The detection signal output unit combines the selection signal, the low limit voltage level, and the high limit voltage level to generate a combined detection signal. The second selection unit selectively outputs one of the selection signal and the combined detection signal as an enable signal. The internal voltage generation unit performs a charge pumping operation in response to the enable signal to generate the internal voltage. The combined detection signal has the modulated voltage level in a first range of temperature section, has the high limit voltage level in a second range of temperature, has the low limit voltage level in a third range of temperature. The second range of temperature has the lower temperature than the first range of temperature; and the third range of temperature has the higher temperature than the first range of temperature section.

DESCRIPTION OF SPECIFIC EMBODIMENTS

Figure 1:
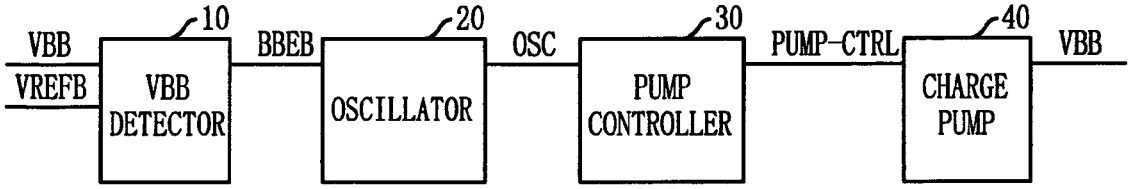
FIG. 1 (PRIOR ART)
FIG. 1 is a block diagram of a conventional bulk bias voltage generator.

Embodiments of the present invention are directed towards an internal voltage detection circuit for an internal address generator, such as the internal address generator depicted in FIG. 1. The internal voltage detection circuit reduces a current consumption by increasing a data retention time of a unit cell at a high temperature. The internal voltage detection circuit increases time taken for writing a data into the unit cell at a low temperature. The internal voltage detection circuit provides an improved test ability and reduces a test cost and a test time by employing test signals and fuse options for controlling the operation. Further, the internal voltage detection circuit prevents an operation error usually caused at very high and very low temperatures.

Figure 4:
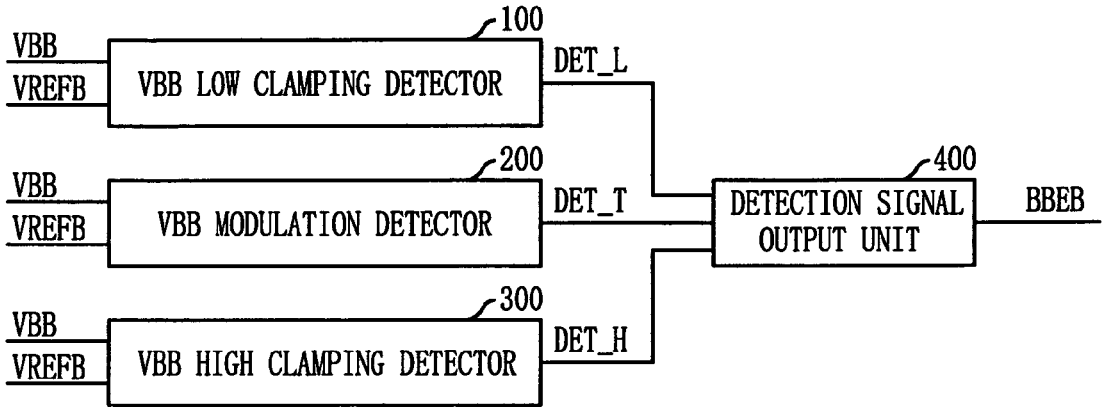
FIG. 4 is a block diagram of a bulk bias voltage (VBB) detector in accordance with an embodiment of the present invention.

FIG. 4 is a block diagram of a bulk bias voltage (VBB) detector in accordance with an embodiment of the present invention.

The VBB detector includes a VBB low clamping detector 100, a VBB modulation detector 200, a VBB high clamping detector 300, and a detection signal output unit 400. The VBB low clamping detector 100 detects a low limit voltage level of the bulk bias voltage VBB and outputs a low limit voltage level signal DET_L. The low limit voltage level signal DET_L has a predetermined constant value. The VBB modulation detector 200 detects the voltage level of the bulk bias voltage VBB dependent on the temperature variation and outputs a modulation voltage level signal DET_T. The modulation voltage level signal DET_T changes linearly depending on temperature variation. The VBB high clamping detector 300 detects a high limit voltage level of the bulk bias voltage VBB and outputs a low voltage high limit voltage level signal DET_H. The high limit voltage level signal DET_H has a predetermined constant value. The detection signal output unit 400 logically combines the high limit voltage level signal DET_H, the modulation voltage level signal DET_T, and the low limit voltage level signal DET_L to generate a pump enable signal BBEB.

Figure 5:
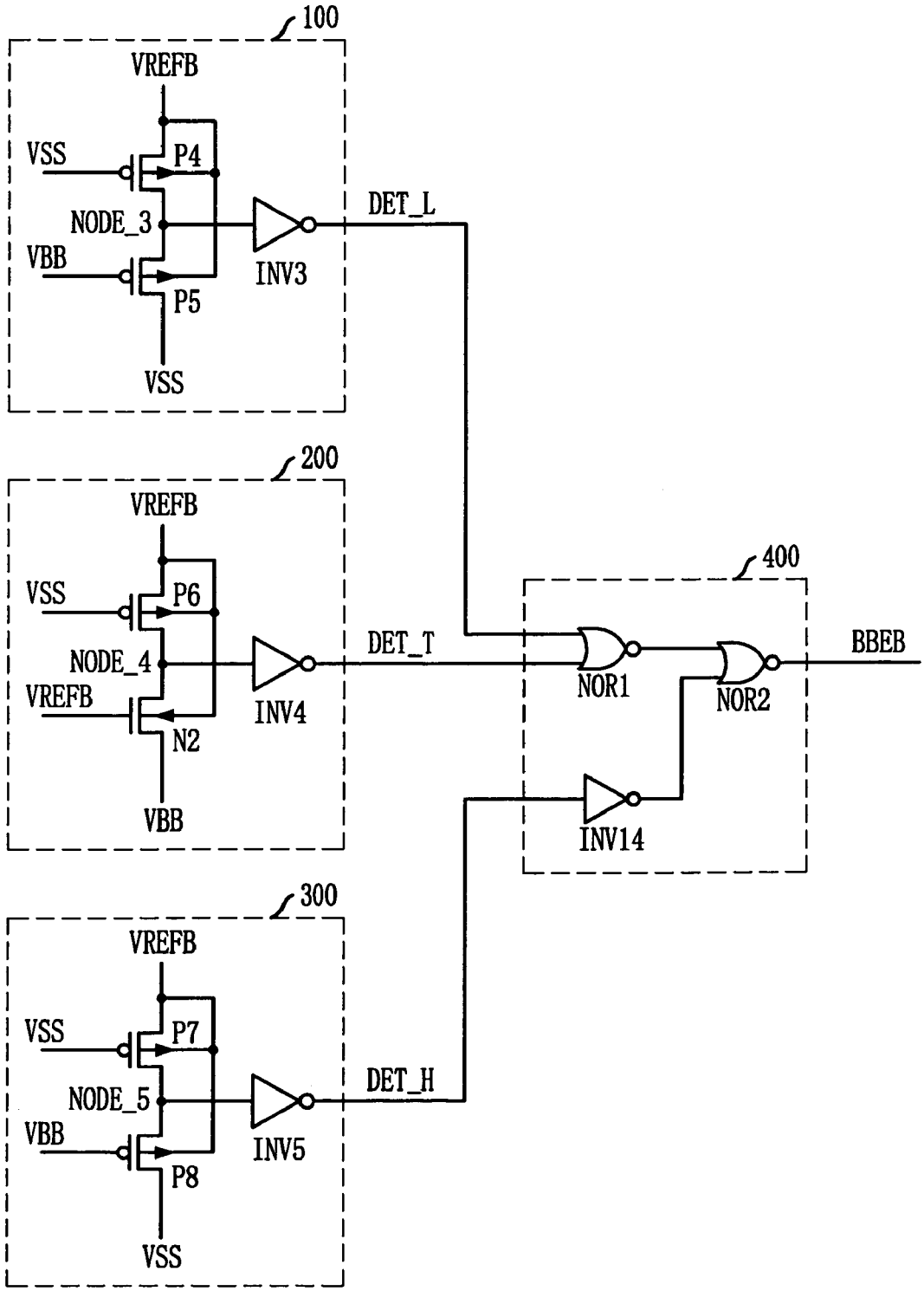
FIG. 5 is a schematic circuit diagram of the VBB detector shown in FIG. 4.

FIG. 5 is a schematic circuit diagram of the VBB detector shown in FIG. 4.

First, the VBB low clamping detector 100 includes two PMOS transistors P4 and P5, serially connected between the reference voltage VREFB terminal and the ground voltage VSS terminal, and a third inverter INV3. The fourth PMOS transistor P4 is connected between the reference voltage VREFB terminal and a third node NODE_3. The fourth PMOS transistor P4 receives the ground voltage VSS through its gate. A bulk of the fourth PMOS transistor P4 is connected to the reference voltage VREFB terminal. The fifth PMOS transistor P5 is connected between the third node NODE_3 and the ground voltage VSS terminal. The fifth PMOS transistor P5 receives the bulk bias voltage VBB through its gate. A bulk of the fifth PMOS transistor P5 is connected to the reference voltage VREFB terminal. The third inverter INV3 inverts a voltage loaded at the third node NODE_3 to thereby output the low limit voltage level signal DET_L.

Figure 2:
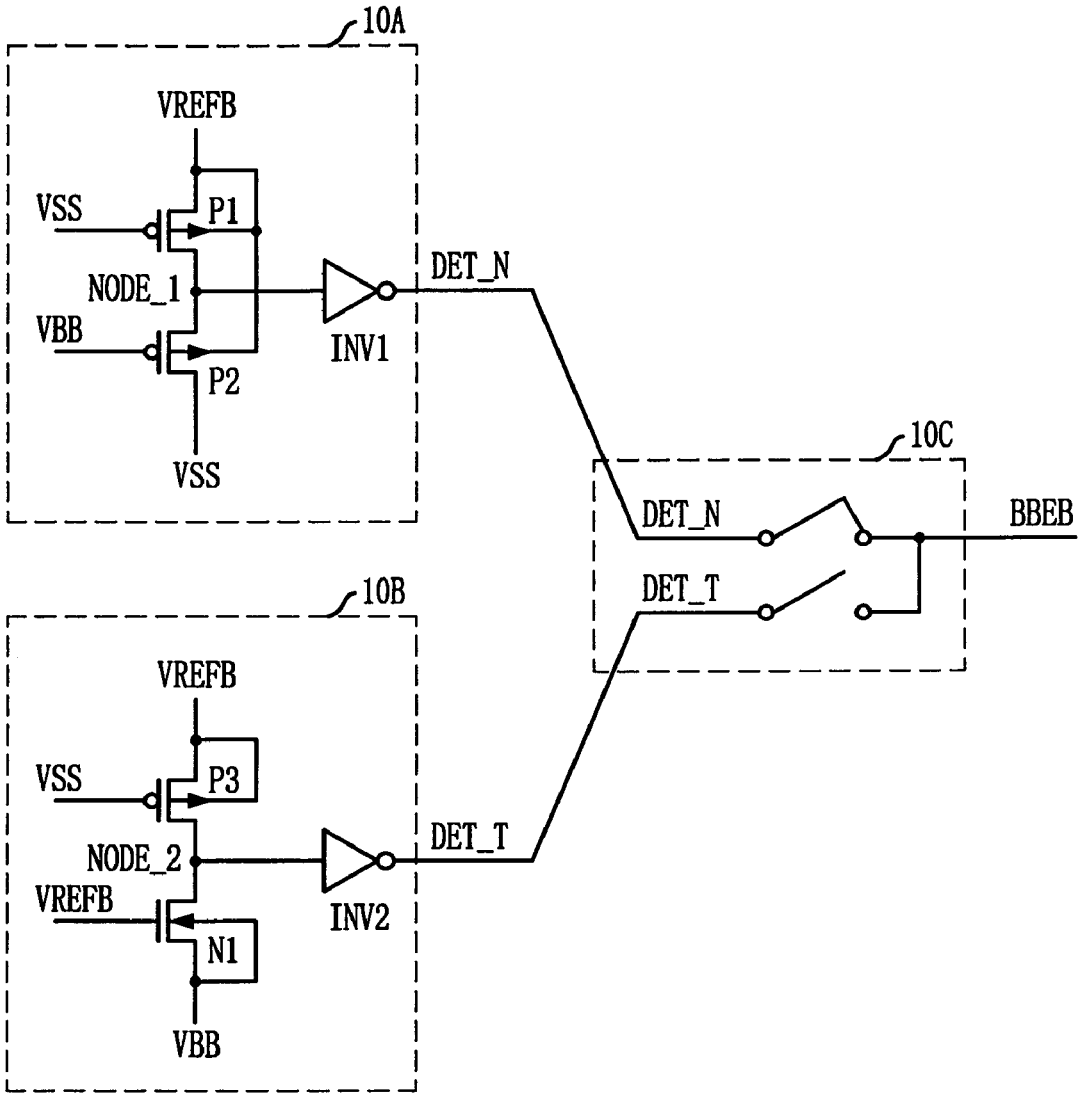
FIG. 2 (PRIOR ART)
FIG. 2 is a schematic circuit diagram of a bulk bias voltage detector shown in FIG. 1.
Figure 3:
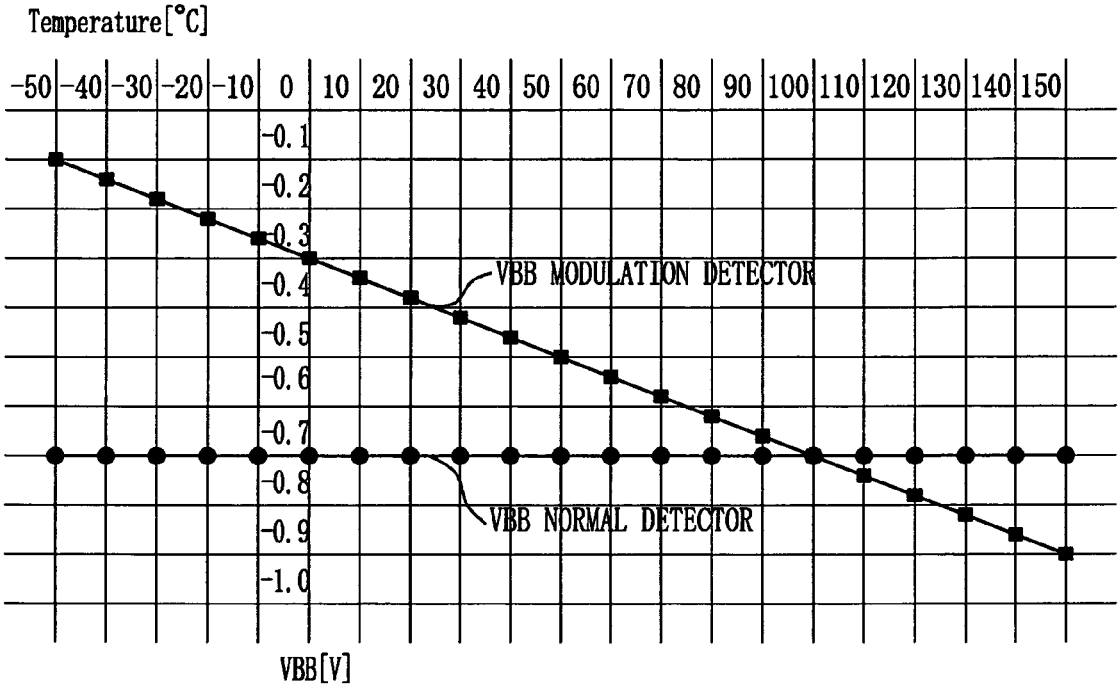
FIG. 3 (PRIOR ART)
FIG. 3 is a graph showing voltage levels of a normal detection value and a modulated detection value respectively output from a VBB normal detector and a VBB modulated detector shown in FIG. 2.

The VBB modulation detector 200 includes a sixth PMOS transistor P6 and a second NMOS transistor N2, serially connected between the reference voltage VREFB terminal and the bulk bias voltage VBB terminal, and a fourth inverter INV4. The sixth PMOS transistor P6 is connected between the reference voltage VREFB terminal and a fourth node NODE_4. The sixth PMOS transistor P6 receives the ground voltage VSS through its gate. A bulk of the sixth PMOS transistor P6 is connected to the reference voltage VREFB terminal. The second NMOS transistor N2 is connected between the fifth node NODE_5 and the bulk bias voltage VBB terminal. The second NMOS transistor N2 receives the reference voltage VREFB through its gate. A bulk of the second NMOS transistor N2 is connected to the bulk bias voltage VBB terminal. The fourth inverter INV4 inverts a voltage loaded at the fourth node NODE_4 to thereby output the modulation voltage level signal DET_T. The VBB modulation detector 200 can be implemented with the similar structure of the VBB modulation detector 10B shown in FIG. 2.

The VBB high clamping detector 300 includes two PMOS transistors P7 and P8, serially connected between the reference voltage VREFB terminal and the ground voltage VSS terminal, and a fifth inverter INV5. The seventh PMOS transistor P7 is connected between the reference voltage VREFB terminal and a fifth node NODE_5. The seventh PMOS transistor P7 receives the ground voltage VSS through its gate. A bulk of the seventh PMOS transistor P7 is connected to the reference voltage VREFB terminal. The eighth PMOS transistor P8 is connected between the fifth node NODE_5 and the ground voltage VSS terminal. The eighth PMOS transistor P8 receives the bulk bias voltage VBB through its gate. A bulk of the eighth PMOS transistor P8 is connected to the reference voltage VREFB terminal. The fifth inverter INV5 inverts a voltage loaded at the fifth node NODE_5 to thereby output the high limit voltage level signal DET_H.

AS described, the low clamping detector 100 and the high clamping detector 300 respectively outputs the low limit voltage level signal DET_H and the high limit voltage level signal DET_L which have the constant value. Therefore, the low clamping detector 100 and the high clamping detector 300 can be implemented with the similar structure of the normal detector 10A shown in FIG. 2. However, the high limit voltage level signal DET_H and the low limit voltage level signal DET_L have the different value from the normal detection value DET_N and, therefore, the size of the NMOS transistor and the PMOS transistors used in the low clamping detector 100 and the high clamping detector 300 have different size with those used in the normal detector 10A.

Finally, the detection signal output unit 400 includes two NOR gate NOR1 and NOR2 and a sixth inverter INV6. The first NOR gate NR1 logically combines the modulation voltage level signal DET_T and the low limit voltage level signal DET_L. The sixth inverter INV6 inverts the high limit voltage level signal DET_H. The second NOR gate NR2 logically combines outputs of the first NOR gate NR1 and the sixth inverter INV6 to generate the pump enable signal BBEB.

When the absolute value of the voltage level of the bulk bias voltage VBB becomes smaller than that of the high limit voltage level, the VBB high clamping detector 300 outputs the high limit voltage level signal DET_H having a logic low level. Accordingly, the pump enable signal BBEB is activated as a logic low level without concerning the modulation voltage level signal DET_T. In response to the activate enable signal BBEB, the pumping operation is performed to decrease the voltage level of the bulk bias voltage VBB. On the other hand, when the absolute value of the voltage level of the bulk bias voltage VBB becomes greater than that of the low limit voltage level, the VBB low clamping detector 100 outputs the low limit voltage level signal DET_L having a logic high level. The pump enable signal BBEB is inactivated as a logic high level in response to the low limit voltage level signal DET_H of the logic high level. Therefore, the pumping operation is not performed to increase the voltage level of the bulk bias voltage VBB.

As a result, in case of using the VBB detector shown in FIG. 5, a modulation voltage level signal DET_T is outputted when the bulk bias voltage VBB has the voltage level between the high limit voltage level and the low limit voltage level. When the voltage level of the bulk bias voltage VBB is lower than the lower limit voltage level, the voltage level of the bulk bias voltage VBB is detected in response to the low limit voltage level signal DET_L without concerning the temperature variation. Further, when the voltage level of the bulk bias voltage VBB is higher than the high limit voltage level, the voltage level of the bulk bias voltage VBB is detected in response to the high limit voltage level signal DET_H without concerning the temperature variation.

Figure 6:
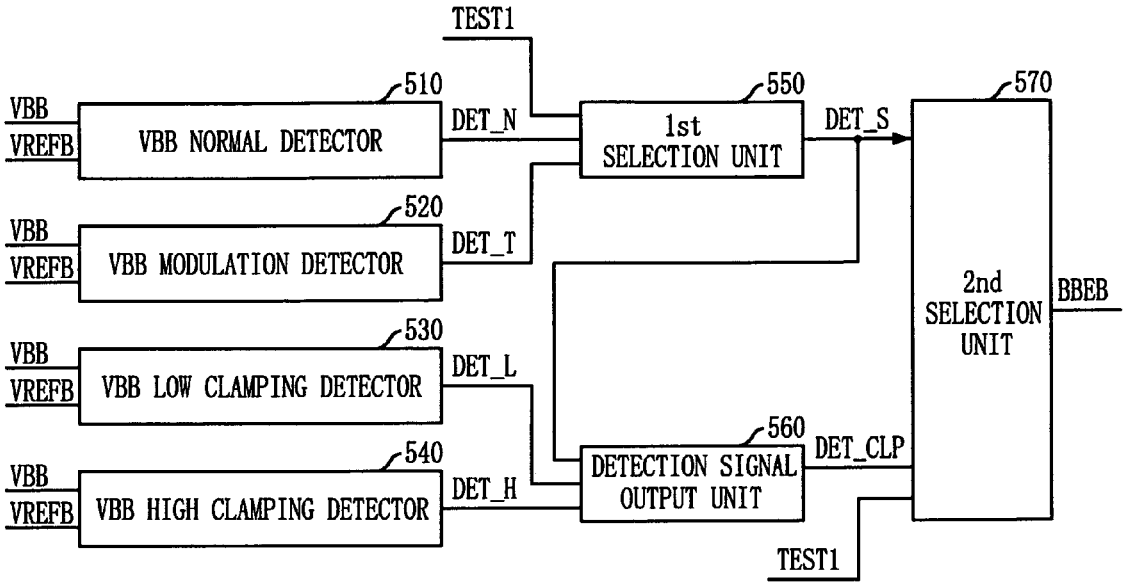
FIG. 6 is a block diagram illustrating a VBB detector in accordance with another embodiment of the present invention.

FIG. 6 is a block diagram illustrating a VBB detector in accordance with another embodiment of the present invention.

The VBB detector includes a VBB normal detector 510, a VBB modulation detector 520, a VBB low clamping detector 530, a VBB high clamping detector 540, first and second selection units 550 and 570, and a detection signal output unit 560. Compared with the VBB detector shown in FIG. 4, the VBB modulation detector 520, the VBB low and high clamping detectors 530 and 540, and the detection signal output unit 560 are substantially the same as those shown in FIG. 4; and the first and the second selection units 550 and 570 and the VBB normal detector 510 are additionally included.

Figure 7:
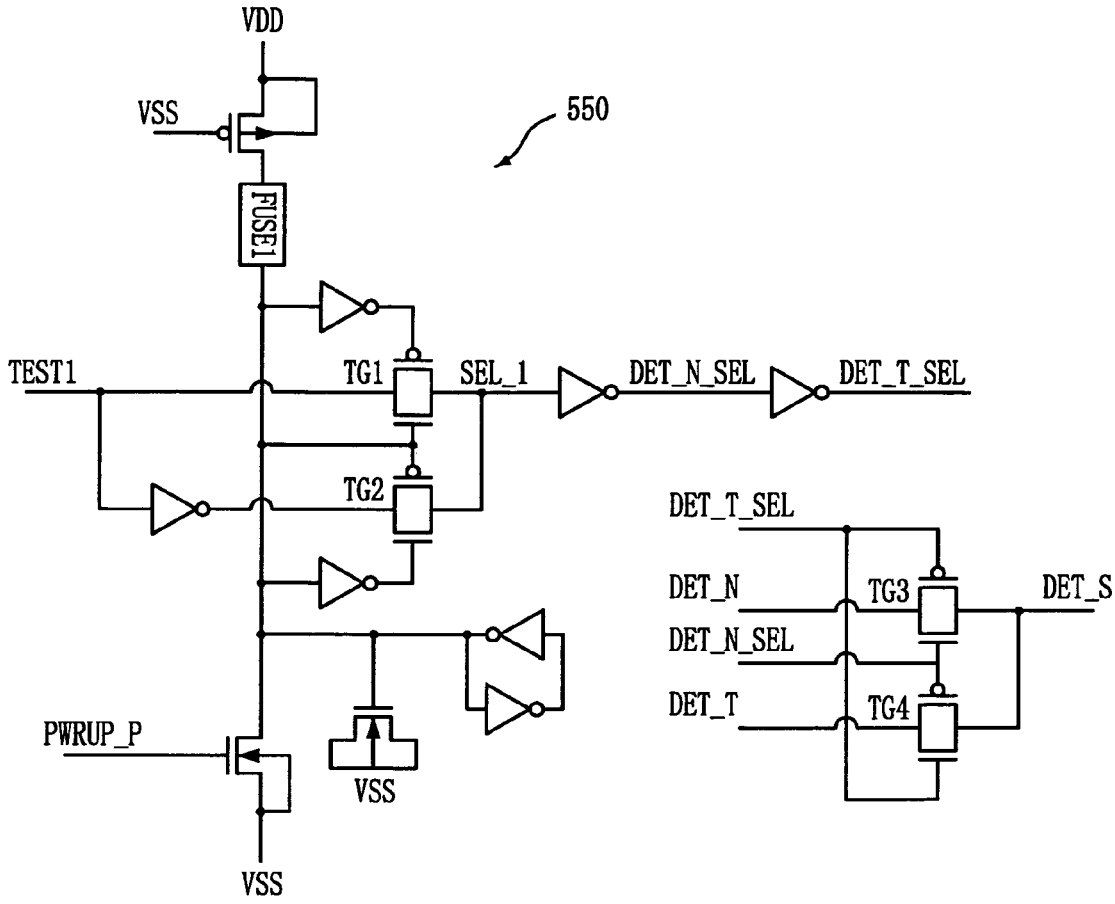
FIG. 7 is a schematic circuit diagram depicting a first selection unit shown in FIG. 6.

FIG. 7 is a schematic circuit diagram depicting the first selection unit 550 shown in FIG. 6.

The first selection unit 550 selects one of a normal detection signal DET_N outputted from the VBB normal detector 510 and a modulated detection signal DET_T outputted from the VBB modulation detector 520 in response to a first test signal TEST1 and a fuse option and outputs the selected one as a selection signal DET_S. In detail, the first selection unit 550 selects the modulated detection signal DET_T in case that a first fuse FUSE1 is connected and the first test signal TEST1 is activated as a logic high level; or in case that the first fuse FUSE1 is cut and the first test signal TEST1 is deactivated as a logic low level. The normal detection value DETT_N is selected as the selection signal DET_S in case that the first fuse FUSE1 is connected and the first test signal TEST1 is deactivated as the logic low level; or in case that the first fuse FUSE1 is cut and the first test signal TEST1 is activated as the logic high level.

Figure 8:
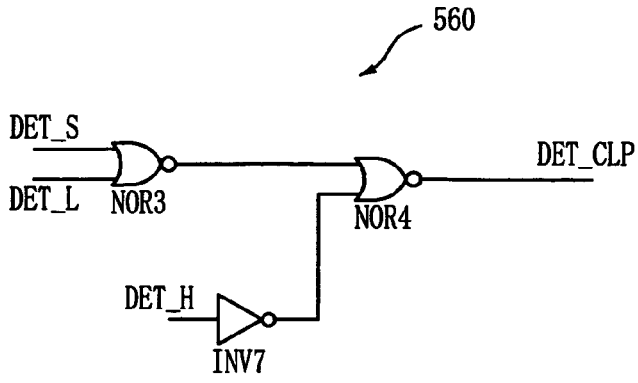
FIG. 8 is a schematic circuit diagram of a detection signal output unit shown in FIG. 6.

FIG. 8 is a schematic circuit diagram of the detection signal output unit 560 shown in FIG. 6.

The detection circuit output unit 560 includes two NOR gates NR3 and NR4 and a seventh inverter INV7. The third NOR gate NR3 logically combines the selection signal DET_S and a low limit voltage level signal DET_L outputted from the low clamping detector 530. The seventh inverter INV7 inverts a high limit voltage level signal DET_H outputted from the high clamping detector 540. The fourth NOR gate NR4 logically combines an output of the third NOR gate NR3 and the inverted high limit voltage level signal DET_H outputted from the seventh inverter INV7 to output a clamping signal DET_CLP. Compared with the detection output unit 400 shown in FIG. 5, the detection output unit 550 has the similar structure only except that the third NOR gate receives the selection signal DET_S instead of the modulated detection signal DET_T and the fourth NOR gate NOR4 outputs the clamping signal DET_CLP instead of the pump enable signal BBEB.

Figure 9:
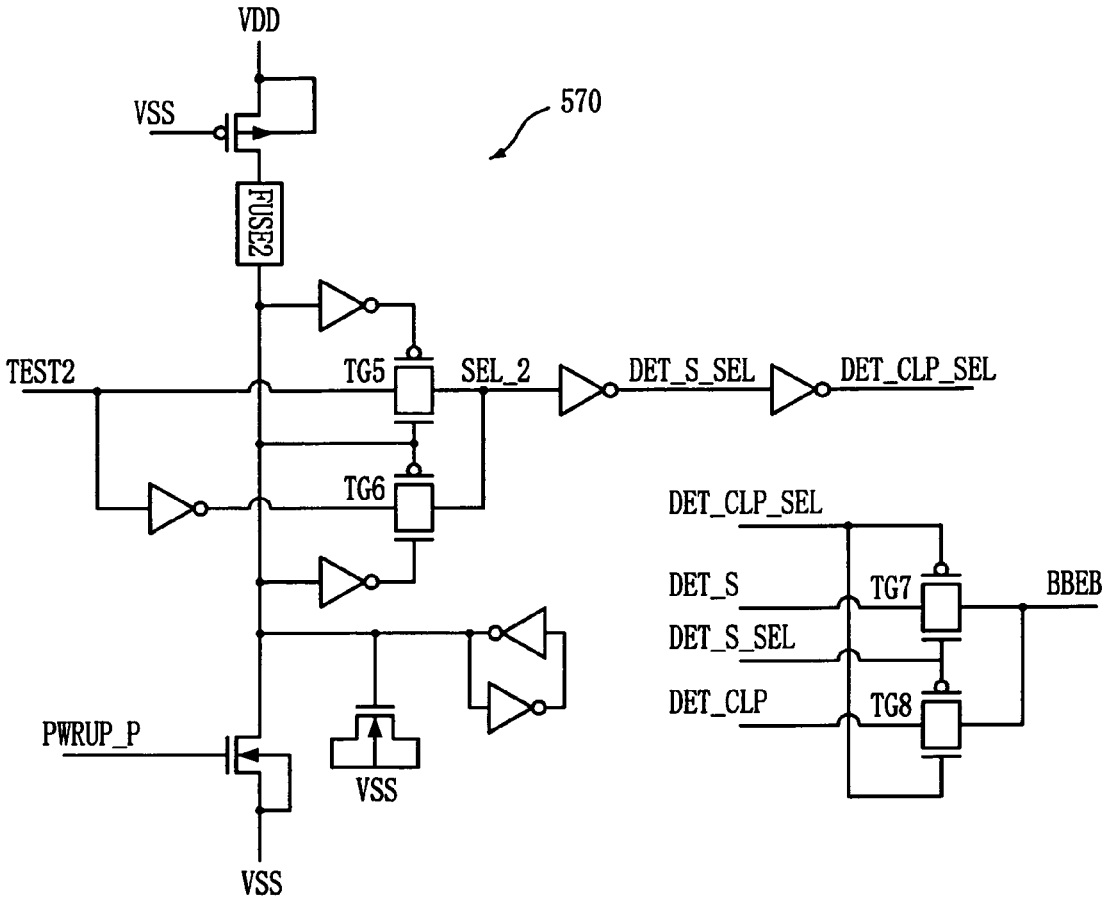
FIG. 9 is a schematic circuit diagram of a second selection unit shown in FIG. 6.

FIG. 9 is a schematic circuit diagram of the second selection unit 570 shown in FIG. 6.

The second selection unit 570 selects one of the selection signal DET_S and the clamping signal DET_CLP in response to a second test signal TEST2 and a fuse option and outputs the selected one as the pump enable signal BBEB. In detail, the second selection unit 570 selects the clamping signal DET_CLP in case that a second fuse FUSE2 is connected and the second test signal TEST2 is activated as a logic high level; or in case that the second fuse FUSE2 is cut and the second test signal TEST2 is deactivated as a logic low level. The selection signal DET_S is selected as the pump enable signal BBEB in case that the second fuse FUSE2 is connected and the second test signal TEST2 is deactivated as the logic low level; or in case that the second fuse FUSE2 is cut and the second test signal TEST2 is activated as the logic high level.

Figure 10:
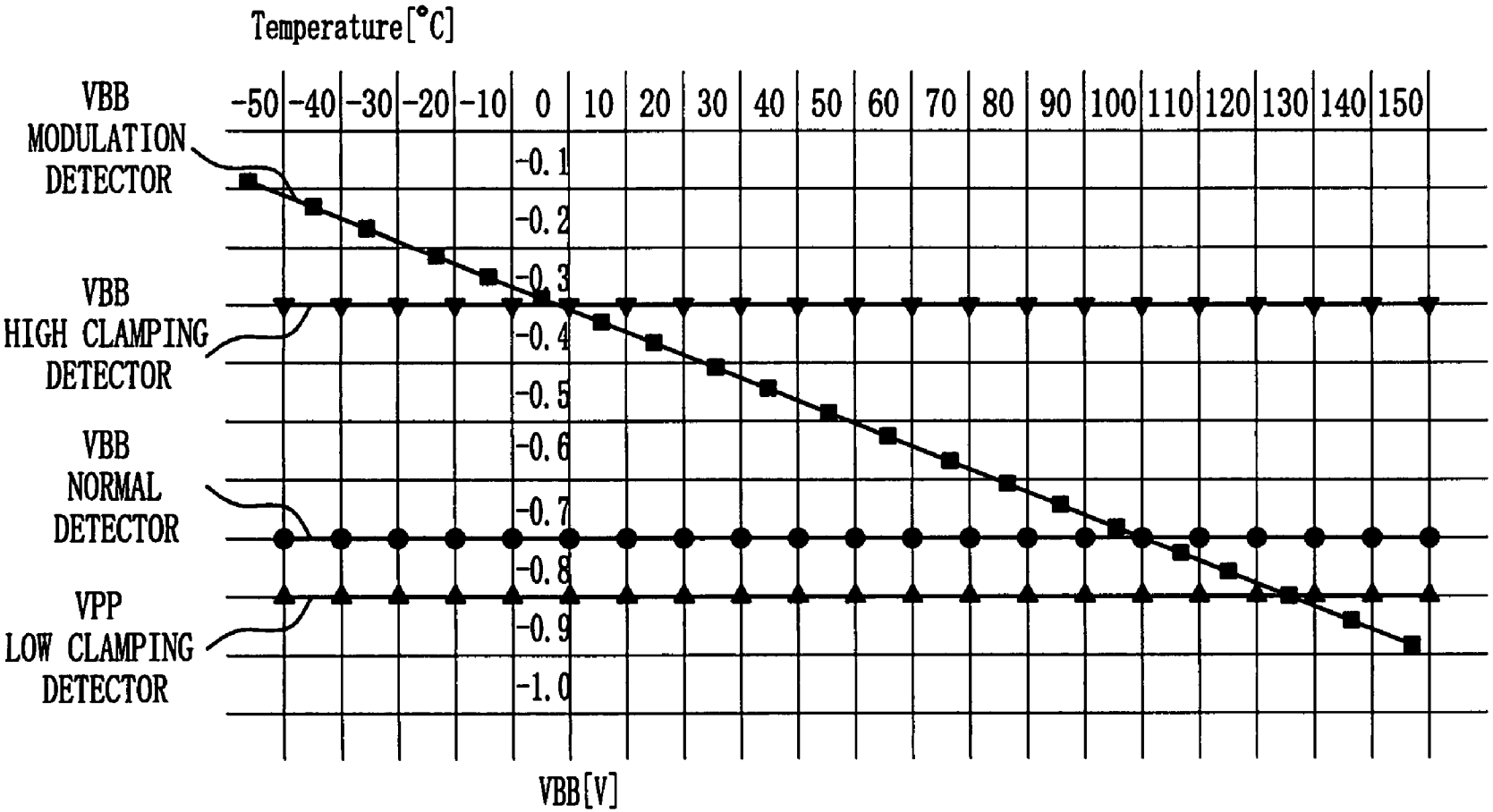
FIG. 10 is a graph illustrating voltage levels of output signals of VBB level detectors shown in FIG. 6, i.e., a VBB normal detector, a VBB modulation detector, and low and high clamping detectors.

FIG. 10 is a graph illustrating voltage levels of output signals of VBB level detectors shown in FIG. 6, i.e., the VBB normal detector 510, the VBB modulation detector 520, and the low and the high clamping detectors 530 and 540.

As shown, the voltage level of the modulated detection signal DET_T varies depending on a temperature. That is, at a very low temperature, e.g., below than −10° C., the modulated detection signal DET_T has a voltage level higher than the high limit voltage level of the bulk bias voltage VBB. Further, at a very high temperature, e.g., upper than 130° C., the modulated detection signal DET_T has a voltage level lower than the low limit voltage level. Meanwhile, the normal detection value DET_N has the constant voltage level being in the range between the low and the high limit voltage level signals DET_L and DET_H without regarding to the temperature.

Figure 11:
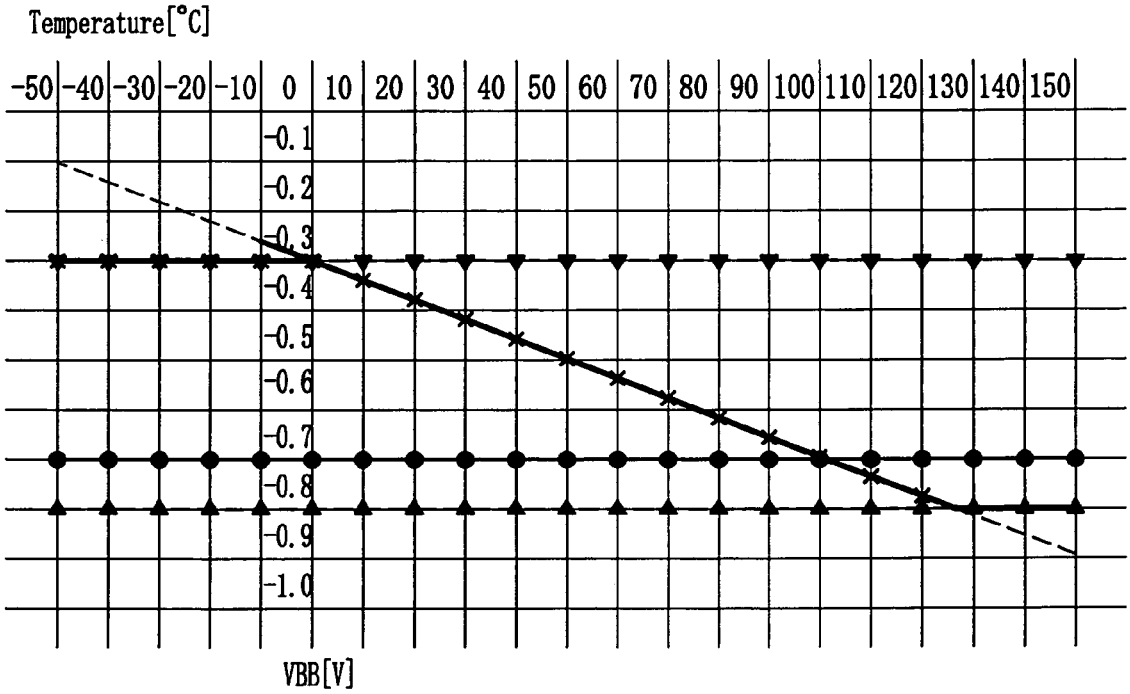
FIG. 11 is a graph illustrating the voltage levels of the output signals of the VBB detectors after being clamped by the detection output unit shown in FIG. 8.

FIG. 11 is a graph illustrating the voltage levels of the output signals of the outputs of the VBB detectors after being clamped by the detection output unit 560 shown in FIG. 8.

The modulated detection signal DET_T at the very low temperature, e.g., below than −10° C., has substantially the same voltage level as the high limit voltage level signal DET_H. Further, at the very high temperature, e.g., upper than 130° C., the modulated detection signal DET_T has substantially the same voltage level as the low limit voltage level signal DET_L.

As described above, the VBB generator including the VBB detector in accordance with the present invention shown in FIG. 6 generates a bulk bias voltage VBB having four different features. First, the bulk bias voltage VBB has a constant voltage level. In this case, the first selection unit 550 selects the normal detection value DET_N as the selection signal DET_S; and the second selection unit 570 selects the selection signal DET_S as the pump enable signal BBEB. Second, the bulk bias voltage VBB has a constant voltage level in a predetermined range. In this case, the first selection unit 550 selects the normal detection value DET_N as the selection signal DET_S; and the second selection unit 570 selects the clamping signal DET_CLP as the pump enable signal BBEB. Third, the VBB generator generates the bulk bias voltage VBB of a voltage level linearly changing in response to a temperature variation. In this case, the first selection unit 550 selects the modulated detection signal DET_T as the selection signal DET_S; and the second selection unit 570 selects the selection signal DET_S as the pump enable signal BBEB. Finally, the bulk bias voltage VBB has a voltage level linearly changing in response to the temperature variation only in a predetermined range. In this case, the first selection unit 550 selects the modulated detection signal DET_T; and the second selection unit 570 selects the clamping value DET_CLP.

Accordingly, the present invention reduces a current consumption by increasing a data retention time of a unit cell at a high temperature. The present invention also increases time taken for writing a data into the unit cell at a low temperature. Further, the present invention provides an improved test ability and reduces a test cost and a test time by employing test signals and fuse options for controlling the operation. Especially, when the clamping signal DET_CLP is selected as the pump enable signal BBEB, the present invention prevents an operation error usually caused at very high and low temperatures.

In addition, the present invention can also be used for various internal voltage generators. For example, the present invention can be used for generating a high voltage VPP having a higher voltage level than a core voltage. The high voltage is inputted to a gate of a cell transistor. Further, the present invention may be employed for controlling a self refresh period.

Figure 12:
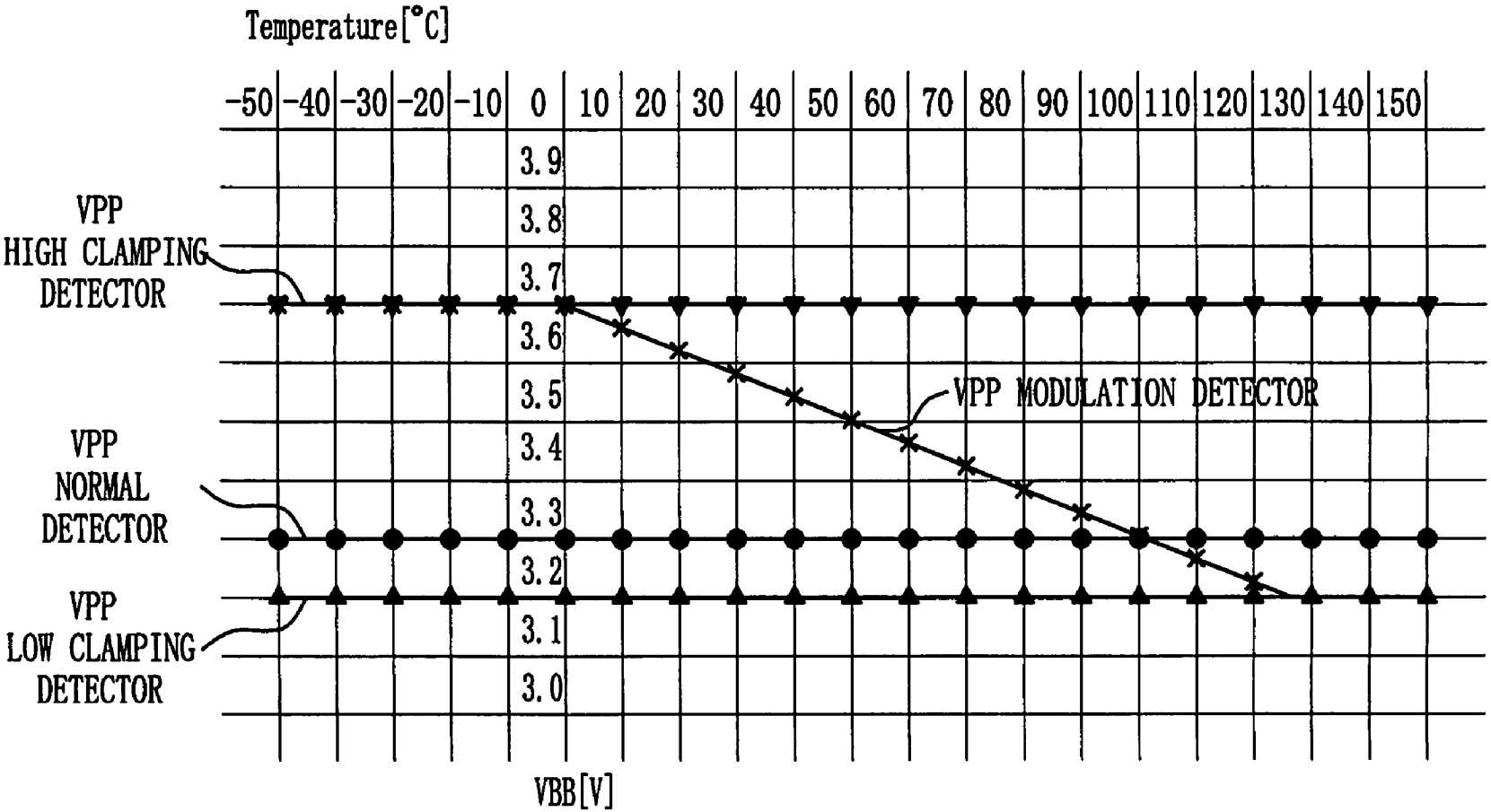
FIG. 12 is a graph illustrating the voltage levels of the output signals of the VBB detectors after being clamped by the detection output unit 560 shown in FIG. 8 when the VBB detector is used for generating the high voltage.

FIG. 12 is a graph illustrating the voltage levels of the output signals of the VBB detectors after clamped by the detection output unit 560 shown in FIG. 8 when the VBB detector is used for generating the high voltage.

While the present invention has been described with respect to the specific embodiments, it will be apparent to those skilled in the art that various changes and modifications may be made without departing from the spirit and scope of the invention as defined in the following claims.

For example, the logic gates and the transistors used in the above embodiments can be arranged in different way and be replaced with another kind of logic gates and transistors according to logic level of the input signals. Further, although both the low limit voltage level and the high limit voltage level of the bulk bias voltage VBB are clamped in the above embodiments, it is also possible to clamp only one of the low limit voltage level and the high limit voltage level in another embodiment.

What is claimed is:

1. An internal voltage generator for use in a semiconductor memory device, comprising:

a first voltage detection unit for detecting a voltage level of an internal voltage changing linearly depending on temperature variation to output a first detection signal;

a second voltage detection unit for detecting the voltage level having a constant value without concerning the temperature variation to output a second detection signal;

a detection signal output unit for combining the first and the second detection signal to generate a combined detection signal for detecting the voltage level linearly varying according to the temperature variation in a first range of temperature and detecting the voltage level having the constant value in a second range of temperature; and an internal voltage generation unit for generating the internal voltage by performing a charge pumping operation in response to the combined detection signal.

2. The internal voltage generator as recited in claim 1, wherein the second range of temperature has the lower temperature than the first range of temperature.

3. The internal voltage generator as recited in claim 1, wherein the second range of temperature has the higher temperature than the first range of temperature.

4. The internal voltage generator as recited in claim 1, wherein the internal voltage generation unit includes:

an oscillator for generating an oscillation signal having a predetermined frequency in response to the combined detection signal;

a pump controller for generating a pump control signal based on the oscillation signal; and a charge pump for performing a charge pumping operation in response to the pump control signal to generate a bulk bias voltage.

5. The internal voltage generator as recited in claim 4, wherein the first voltage detection unit includes:

a first PMOS transistor for receiving a ground voltage through its gate and receiving a reference voltage through its first terminal and bulk, whose second terminal is connected to a first node;

an NMOS transistor for receiving the reference voltage through its gate and receiving the bulk bias voltage through its first terminal and bulk, whose second terminal is connected to the first node; and a first inverter for inverting a voltage loaded at the first node to output the first detection signal, wherein the reference voltage has a target level of the bulk bias voltage.

6. The internal voltage generator as recited in claim 5, wherein the second voltage detection unit includes:

a second PMOS transistor for receiving the ground voltage through its gate and receiving the reference voltage through its first gate and bulk, whose second terminal is connected to a second node;

a third PMOS transistor for receiving the bulk bias voltage through its gate and receiving the ground voltage through its first terminal and bulk, whose second terminal is connected to the second node; and a second inverter for inverting a voltage loaded at the second node to output the second detection signal.

7. An internal voltage generator for use in a semiconductor memory device, comprising:

a first voltage detection unit for detecting a modulated voltage level of an internal voltage changing linearly depending on a temperature variation to output a first detection signal;

a second voltage detection unit for detecting a high limit voltage level of the internal voltage having a first constant value without concerning the temperature variation;

a third voltage detection unit for detecting a low limit voltage level of the internal voltage unit having a second constant value without concerning the temperature variation;

a detection signal output unit for combining the modulated voltage level, the low limit voltage level, and the high limit voltage level to generate a combined detection signal; and an internal voltage generation unit for performing a charge pumping operation in response to the combined detection signal to generate the internal voltage, wherein the combined detection signal has the modulated voltage level in a first range of temperature, has the high limit voltage level in a second range of temperature, has the low limit voltage level in a third range of temperature.

8. The internal voltage generator as recited in claim 7, wherein the second range of temperature has the lower temperature than the first range of temperature; and the third range of temperature has the higher temperature than the first range of temperature.

9. The internal voltage generator as recited in claim 8, wherein the internal voltage generation unit includes:

an oscillator for generating an oscillation signal having a predetermined frequency in response to the combined detection signal;

a pump controller for generating a pump control signal based on the oscillation signal; and a charge pump for performing a charge pumping operation in response to the pump control signal to generate a bulk bias voltage.

10. The internal voltage generator as recited in claim 9, wherein the first voltage detection unit includes:

a first PMOS transistor for receiving a ground voltage through its gate and receiving a reference voltage through its first terminal and bulk, whose second terminal is connected to a first node;

an NMOS transistor for receiving the reference voltage through its gate and receiving the bulk bias voltage though its first terminal and bulk, whose second terminal is connected to the first node; and a first inverter for inverting a voltage loaded at the first node to output the modulated voltage level, wherein the reference voltage has a target level of the bulk bias voltage.

11. The internal voltage generator as recited in claim 10, wherein the second voltage detection unit includes:

a second PMOS transistor for receiving the ground voltage through its gate and receiving the reference voltage through its first gate and bulk, whose second terminal is connected to a second node;

a third PMOS transistor for receiving the bulk bias voltage through its gate, receiving the ground voltage through its second terminal, and receiving the reference voltage through its bulk, whose first terminal is connected to the second node; and a second inverter for inverting a voltage loaded at the second node to output the high limit voltage level.

12. The internal voltage generator as recited in claim 11, wherein the third voltage detection unit includes:

a fourth PMOS transistor for receiving the ground voltage through its gate and receiving the reference voltage through its first gate and bulk, whose second terminal is connected to a third node;

a fifth PMOS transistor for receiving the bulk bias voltage through its gate, receiving the ground voltage through its second terminal, and receiving the reference voltage through its bulk, whose first terminal is connected to the third node; and a third inverter for inverting a voltage loaded at the third node to output the low limit voltage level.

13. The internal voltage generator as recited in claim 8, wherein the detection signal output unit includes:

a first NOR gate for logically combining the modulated voltage level and the low limit voltage level;

an inverter for inverting the high limit voltage level;

a second NOR gate for logically combining outputs of the first NOR gate and the inverter to output the combined detection signal.

14. An internal voltage generator for use in a semiconductor memory device, comprising:

a first voltage detection unit for detecting a modulated voltage level of an internal voltage changing linearly depending on a temperature variation to output a first detection signal;

a second voltage detection unit for detecting a high limit voltage level of the internal voltage having a first constant value without concerning the temperature variation;

a third voltage detection unit for detecting a low limit voltage level of the internal voltage unit having a second constant value without concerning the temperature variation;

a fourth voltage detection unit for detecting a normal voltage level having a third constant value lower than the high limit voltage level and higher than the low limit voltage level;

a first selection unit for selectively outputting one of the modulated voltage level and the normal voltage level as a selection signal;

a detection signal output unit for combining the selection signal, the low limit voltage level, and the high limit voltage level to generate a combined detection signal;

a second selection unit for selectively outputting one of the selection signal and the combined detection signal as an enable signal; and an internal voltage generation unit for performing a charge pumping operation in response to the enable signal to generate the internal voltage, wherein the combined detection signal has the modulated voltage level in a first range of temperature, has the high limit voltage level in a second range of temperature, has the low limit voltage level in a third range of temperature.

15. The internal voltage generator as recited in claim 14, wherein the second range of temperature has the lower temperature than the first range of temperature; and the third range of temperature has the higher temperature than the first range of temperature.

16. The internal voltage generator as recited in claim 15, wherein the internal voltage generation unit includes:

an oscillator for generating an oscillation signal having a predetermined frequency in response to the combined detection signal;

a pump controller for generating a pump control signal based on the oscillation signal; and a charge pump for performing a charge pumping operation in response to the pump control signal to generate a bulk bias voltage.

17. The internal voltage generator as recited in claim 16, wherein the first voltage detection unit includes:

a first PMOS transistor for receiving a ground voltage through its gate and receiving a reference voltage through its first terminal and bulk, whose second terminal is connected to a first node;

an NMOS transistor for receiving the reference voltage through its gate and receiving the bulk bias voltage though its first terminal and bulk, whose second terminal is connected to the first node; and a first inverter for inverting a voltage loaded at the first node to output the modulated voltage level, wherein the reference voltage has a target level of the bulk bias voltage.

18. The internal voltage generator as recited in claim 17, wherein the second voltage detection unit includes:

a second PMOS transistor for receiving the ground voltage through its gate and receiving the reference voltage through its first gate and bulk, whose second terminal is connected to a second node;

a third PMOS transistor for receiving the bulk bias voltage through its gate, receiving the ground voltage through its second terminal, and receiving the reference voltage through its bulk, whose first terminal is connected to the second node; and a second inverter for inverting a voltage loaded at the second node to output the high limit voltage level.

19. The internal voltage generator as recited in claim 18, wherein the third voltage detection unit includes:

a fourth PMOS transistor for receiving the ground voltage through its gate and receiving the reference voltage through its first gate and bulk, whose second terminal is connected to a third node;

a fifth PMOS transistor for receiving the bulk bias voltage through its gate, receiving the ground voltage through its second terminal, and receiving the reference voltage through its bulk, whose first terminal is connected to the third node; and a third inverter for inverting a voltage loaded at the third node to output the low limit voltage level.

20. The internal voltage generator as recited in claim 19, wherein the third voltage detection unit includes:

a sixth PMOS transistor for receiving the ground voltage through its gate and receiving the reference voltage through its first gate and bulk, whose second terminal is connected to a fourth node;

a seventh PMOS transistor for receiving the bulk bias voltage through its gate, receiving the ground voltage through its second terminal, and receiving the reference voltage through its bulk, whose first terminal is connected to the fourth node; and a fourth inverter for inverting a voltage loaded at the fourth node to output the normal voltage level.

21. The internal voltage generator as recited in claim 15, wherein the detection signal output unit includes:

a first NOR gate for logically combining the selection signal and the low limit voltage level;

an inverter for inverting the high limit voltage level;

a second NOR gate for logically combining outputs of the first NOR gate and the inverter to output the combined detection signal.

* * * * *